US005246221A

United States Patent [19]

Sugimoto et al.

[11] Patent Number: 5,246,221

[45] Date of Patent: * Sep. 21, 1993

[54] PAPER FEEDING DEVICE

[75] Inventors: Yuji Sugimoto, Nara; Kenji Okada, Saijo; Hiranaga Yamamoto, Yamatokoriyama, all of Japan

[73] Assignee: Sharp Kabushika Kaisha, Osaka, Japan

[ * ] Notice: The portion of the term of this patent subsequent to Dec. 22, 2009 has been disclaimed.

[21] Appl. No.: 952,286

[22] Filed: Sep. 28, 1992

Related U.S. Application Data

[63] Continuation of Ser. No. 738,260, Jul. 30, 1991, Pat. No. 5,172,901.

[30] Foreign Application Priority Data

Jul. 31, 1990 [JP] Japan ..... 2-205694
Jul. 31, 1990 [JP] Japan ..... 2-205695
Aug. 31, 1990 [JP] Japan ..... 2-231558

[51] Int. Cl.[5] ..... A65H 1/08

[52] U.S. Cl. ..... 271/127; 271/157; 271/160

[58] Field of Search ..... 271/126, 127, 157, 160, 271/162, 164, 241

[56] References Cited

U.S. PATENT DOCUMENTS 4,998,137 3/1991 Ida et al. ..... 271/145 X
5,046,715 9/1991 Taniguchi et al. ..... 271/164
5,083,767 1/1992 Iwamoto et al. ..... 271/162 X
5,100,122 3/1992 Noda et al. ..... 271/162 X

FOREIGN PATENT DOCUMENTS 0127329 5/1990 Japan ..... 271/162
0132021 5/1990 Japan ..... 271/162

*Primary Examiner*—H. Grant Skaggs
*Assistant Examiner*—Carol Lynn Druzbick
*Attorney, Agent, or Firm*—David G. Conlin; Robert F. O'Connell

[57] ABSTRACT

A paper feeding device comprising a tray storing case attachable to and removable from a device housing; a rotatable tray, provided in the tray storing case, which rotates copy paper to a longitudinal and lateral feed position; and a mechanism for lifting up a paper-feed end of a paper holding plate provided in the tray when paper is to be fed. The mechanism is composed of a guide member provided in the device housing; a lift-up guide provided on a side face located on a paper-feed end of the tray; a first rotary bar provided in the tray storing case and driven by the guide member when the tray is attached thereon; and a second rotary bar, a spring and a lift plate driven by the lift-up guide when the tray is in the paper-feed position. The first and second bars are driven simultaneously, thus lifting up the paper-feed end of the paper holding plate. Alternatively, the mechanism comprises at least three springs provided between the tray and the tray storing case; a guide rib provided in the tray storing case; and a pivot pin, a wire and a slide plate provided on the paper holding plate. The guide rib causes the slide plate to rotate and the wire pulls the pivot pin downwards. A simplified and miniaturized mechanism that lifts up and lowers the paper holding plate is thus achieved.

5 Claims, 17 Drawing Sheets

PAPER FEEDING DEVICE

This is a continuation of copending application Ser. No. 07/738,260 filed on Jul. 30, 1991, now U.S. Pat. No. 5,172,901.

FIELD OF THE INVENTION

The present invention relates to a paper feeding device comprising a rotatable paper tray which is rotatable to longitudinal and lateral feed positions with respect to copy paper stored therein.

BACKGROUND OF THE INVENTION

Conventionally, a paper feeding device is provided in, for example, a copying machine for feeding copy paper thereto. Among various types of such a feeding device, there is one wherein a rotatable paper tray which is rotatable to longitudinal and lateral feed positions is provided in order to feed the copy paper oriented longitudinally and laterally with respect to a feeding direction. In such a feeding device, the copy paper is stacked on a paper holding plate provided in the rotatable paper tray. The paper holding plate is lifted up and lowered by a lift-up mechanism, the lift-up mechanism being independent of the rotating operation of the rotatable paper tray and being driven by a motor. That is, a paper-feed end of the paper holding plate is lifted up and maintained in an inclined state by a lift plate coupled to the motor. The paper-feed end is lifted up to an upper-limit position where the copy paper is detected by an upper-limit detecting switch. Paper feeding then takes place according to the pick-up roller method.

However, in the conventional lift-up mechanism, a plurality of driving and transmission devices such as electro-magnetic clutches and gears are necessary in a driving mechanism which drives the lift plate, and a plurality of sensors are needed to control the driving mechanism, the sensors detecting the upper-limit position, a lower-limit position etc. of the copy paper. Moreover, a bulky decelerating device is necessary to decelerate the rotation speed of the motor in order to lift up the paper holding plate at a suitable speed. Consequently, a configuration thereof becomes more complicated and an increase in cost results.

SUMMARY OF THE INVENTION

An object of the present invention is to provide a paper feeding device that can reliably carry cut lifting up and lowering of a paper holding plate when the paper holding plate is in a longitudinal or lateral feed position.

Another object of the present invention is to provide a paper feeding device that can simplify and reduce the cost of a mechanism that lifts up and lowers the paper holding plate.

In order to attain the above objects, a paper feeding device of the present invention comprises: a tray storing member which is attachable to and removable from a device housing; a rotatable tray provided in the tray storing member, the tray being rotatable to a longitudinal feed position for feeding copy paper oriented longitudinally with respect to a feeding direction of the copy paper, and to a lateral feed position for feeding the copy paper oriented laterally with respect to a feeding direction; a paper holding plate, which can be lifted up and lowered, provided in the tray, the copy paper being stacked on the paper holding plate; and a paper holding plate driving member, provided in the tray storing member under a bottom section of the paper holding plate, for lifting up and lowering the paper holding plate to a paper-feed position and to a lowered position by respectively applying and relaxing force on the paper holding plate. The paper feeding device is provided with the following means.

The paper feeding device comprises: a guide member provided in the device housing; a lifting up guide member provided on a side face toward a paper-feed end of the tray when the tray is in the paper-feed position; a first driven member, such as a rotary bar, provided in the tray storing member and driven by the guide member when the tray is attached to the device housing; a second driven member provided in the tray storing member and driven by the lifting up guide member when the tray is in the paper-feed position; a driving force applying mechanism for transmitting a driving force to the paper holding plate driving member when the first driven member and the second driven member are simultaneously driven by, respectively, the guide member and the lifting up guide member; and a driving force transmission mechanism provided in the tray storing member, the driving force transmission mechanism being coupled to the paper holding plate driving member and transmitting the driving force transmitted therefrom to the paper holding plate driving member so as to exert a force on the paper holding plate.

With the above arrangement, when the tray storing member comprising the tray is attached to the paper feeding device housing, the first driven member (provided in the tray storing member) of the driving force applying mechanism is driven by the guide member provided in the paper feeding device housing. In this state, when the tray is set to the longitudinal or lateral feed position, the second driven member of the driving force applying mechanism is driven by the lifting up guide member provided on the tray, the second driven member being provided in the tray storing member and being coupled to the first driven member. Consequently, the driving force applying mechanism transmits the driving force applied on the first driven member and the second driven member to the paper holding plate driving member. This driving force is transmitted to the paper holding plate driving member so that a force is applied by the driving force transmission mechanism to the paper holding plate. The paper-feed end of the paper holding plate is thus lifted up and is ready to feed the copy paper.

When, however, the tray begins to rotate from the longitudinal to the lateral feed position or vice versa, the second driven member of the driving force applying mechanism separates from the lifting up guide member. Consequently, the driving force is no longer exerted on the paper holding plate driving member, causing the paper holding plate to be lowered. Further, in a case where the tray storing member is removed from the paper feeding device housing when the tray is in the longitudinal or lateral feed position, the first driven member of the driving force applying mechanism separates from the guide member and, similarly, the driving force is no longer exerted on the paper holding plate driving member, causing the paper holding plate to be lowered.

Thus it becomes possible to lift up and lower the paper holding plate using a simple configuration, without having to provide a bulky decelerating device. A lower cost and simplification of the configuration can thereby be achieved.

In order to attain the above objects, another paper feeding device of the present invention comprises: a junction section, supported to be freely raisable and lowerable and provided on an end section of the paper holding plate, the end section being located opposite to a paper-feed end of the paper holding plate; an elastic member, such as springs, provided between a paper holding plate storing member and the paper holding plate; a guide member provided in the tray storing member; a displacement member, such as a slide plate, provided in the paper holding plate storing member, the displacement member being displaced on being guided by the guide member when the tray is in the paper-feed position; and a displacement transmission mechanism for transmitting the displacement of the displacement member as a force for pulling down the junction section.

With the above arrangement, the elastic member exerts an upward force on the paper holding plate. Here, when the tray is, for example, in the lateral feed position, the displacement member provided in the paper holding plate storing member is displaced on being guided by the guide member. The displacement of the displacement member is transmitted by the displacement transmission mechanism as the force for pulling down the junction section. Consequently, the junction section opposes the upward force exerted by the elastic member on the paper holding plate and the junction section is lowered. As a result, the paper-feed end of the paper holding plate is lifted up and the paper holding plate is ready to feed the copy paper. When the tray is in the longitudinal feed position, the tray feeds the copy paper according to a similar operation.

A supported section, which is a corner section of the paper holding plate, is supported by the paper holding plate storing member. The supported section lies diagonally opposite to a common-corner section which is located toward a paper feed direction both in the case where the paper holding plate is in the longitudinal feed position and in the case where the paper holding plate is in the lateral feed position. The elastic member comprises at least a first to a third spring and it is desirable that the springs be positioned so as to fulfill the following conditions.

The first spring and the second spring should respectively be provided in two areas of the paper holding plate, the areas being formed by an imaginary straight line connecting the common-corner section and the supported section of the paper storing plate. The third spring should be provided in an area close to the supported section of the paper holding plate, the area being formed by an intersection of a first imaginary straight line and a second imaginary straight line. The first imaginary straight line passes through a center of the first spring and is parallel to an imaginary straight line extending from the supported section of the paper holding plate toward a paper feed direction which is oriented toward the first spring; and the second imaginary straight line passes through a center of the second spring and is parallel to an imaginary straight line extending from the supported section of the paper holding plate toward a paper feed direction which is oriented toward the second spring.

Here, the first and second springs serve to lift up the paper-feed end of the paper holding plate during the longitudinal and lateral feed. However, when only the first and second springs are provided, an axis is formed connecting the supported section and the common-corner section. The axis is formed due to the fact that the supported section of the paper holding plate (which is the corner section located on a side opposite to the paper-feed end) is supported by the paper holding plate storing member; and due to a compression of either the first or the second spring because of the operation of the displacement transmission mechanism. The axis causes a downward force to be exerted on a corner section which is located toward the paper feed direction and which is adjacent the common-corner section. Because of the downward force exerted due to the axis, clip members of the corner sections of the paper holding plate cannot properly clamp down corner sections of the copy paper. This results in double feeding or improperly angled feeding of the copy paper. However, this problem has been resolved here by providing the third spring on the area close to the supported section of the paper holding plate, the area being formed by the intersection of the first imaginary straight line and the second imaginary straight line, the first imaginary straight line passing through the center of the first spring and parallel to the imaginary straight line extending from the supported section of the paper holding plate toward the paper feed direction which is oriented toward the first spring, and the second imaginary straight line passing through the center of the second spring and parallel to the imaginary straight line extending from the supported section of the paper holding plate toward the paper feed direction which is oriented toward the second spring. That is, the third spring cancels out the downward force which is exerted on the corner section located toward the paper feed direction and which is adjacent the common-corner section. As a result, the clip members of the corner sections can properly clamp down the corner sections of the copy paper.

Accordingly, defects such as double feeding or improperly angled feeding can be prevented since all the clip members reliably clamp corner sections of the copy paper. Moreover, the configuration is simplified and made cheaper by an arrangement whereby the paper holding plate is pushed upwards by the elastic member.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) shows a plan view of a rotatable paper tray unit which has been removed from a paper feeding device housing.

FIG. 1(*b*) shows a vertical sectional view of the rotatable paper tray unit which has been removed from the paper feeding device housing.

FIG. 1(*c*) shows a plan view of a driving force applying mechanism and a driving force transmission mechanism after the rotatable paper tray unit has been removed from the paper feeding device housing.

FIG. 2(*a*) shows a plan view of the rotatable paper tray unit when a rotatable paper tray is in a longitudinal feed position.

FIG. 2(*b*) shows a vertical sectional view of the rotatable paper tray unit when the rotatable paper tray is in the longitudinal feed position.

FIG. 2(*c*) shows a plan view of the driving force applying mechanism and the driving force transmission mechanism when the rotatable paper tray is in the longitudinal feed position.

FIG. 3 shows a plan view of the rotatable paper tray unit when the rotatable paper tray is in an initial stage of rotating from the longitudinal feed position to a lateral feed position.

FIG. 4(*a*) shows a plan view of the rotatable paper tray unit when the rotatable paper tray is in a later stage of rotating from the longitudinal feed position to the lateral feed position.

FIG. 4(*b*) shows a vertical sectional view of the rotatable paper tray unit when the rotatable paper tray is in the later stage of rotating from the longitudinal feed position to the lateral feed position.

FIG. 4(*c*) shows a plan view of the driving force applying mechanism and the driving force transmission mechanism when the rotatable paper tray is in the later stage of rotating from the longitudinal feed position to the lateral feed position.

FIG. 5 shows a plan view of the rotatable paper tray unit when the rotatable paper tray is in the lateral feed position.

FIG. 6 shows a plan view of a rotatable paper tray unit when a rotatable paper tray is in a lateral feed position.

FIG. 7 shows a vertical view of the rotatable paper tray when the rotatable paper tray is in the lateral feed position.

FIG. 8 is a perspective view showing essential parts of the rotatable paper tray when the rotatable paper tray is in the lateral feed position.

FIG. 9 is a perspective view schematically showing a configuration whereby a rotary pivot rod is pulled down by a lateral feed lift slide plate when the rotatable paper tray is in the lateral feed position.

FIG. 10 is a plan view showing relative positioning of coiled springs on an outer case.

FIG. 11 shows a plan view of the rotatable paper tray unit when the rotatable paper tray is in a longitudinal feed position.

DETAILED DESCRIPTION OF THE PREFERRED EMBODIMENTS

An embodiment of the present invention is described hereinbelow, referring to FIGS. 1 to 5.

Figure 1:
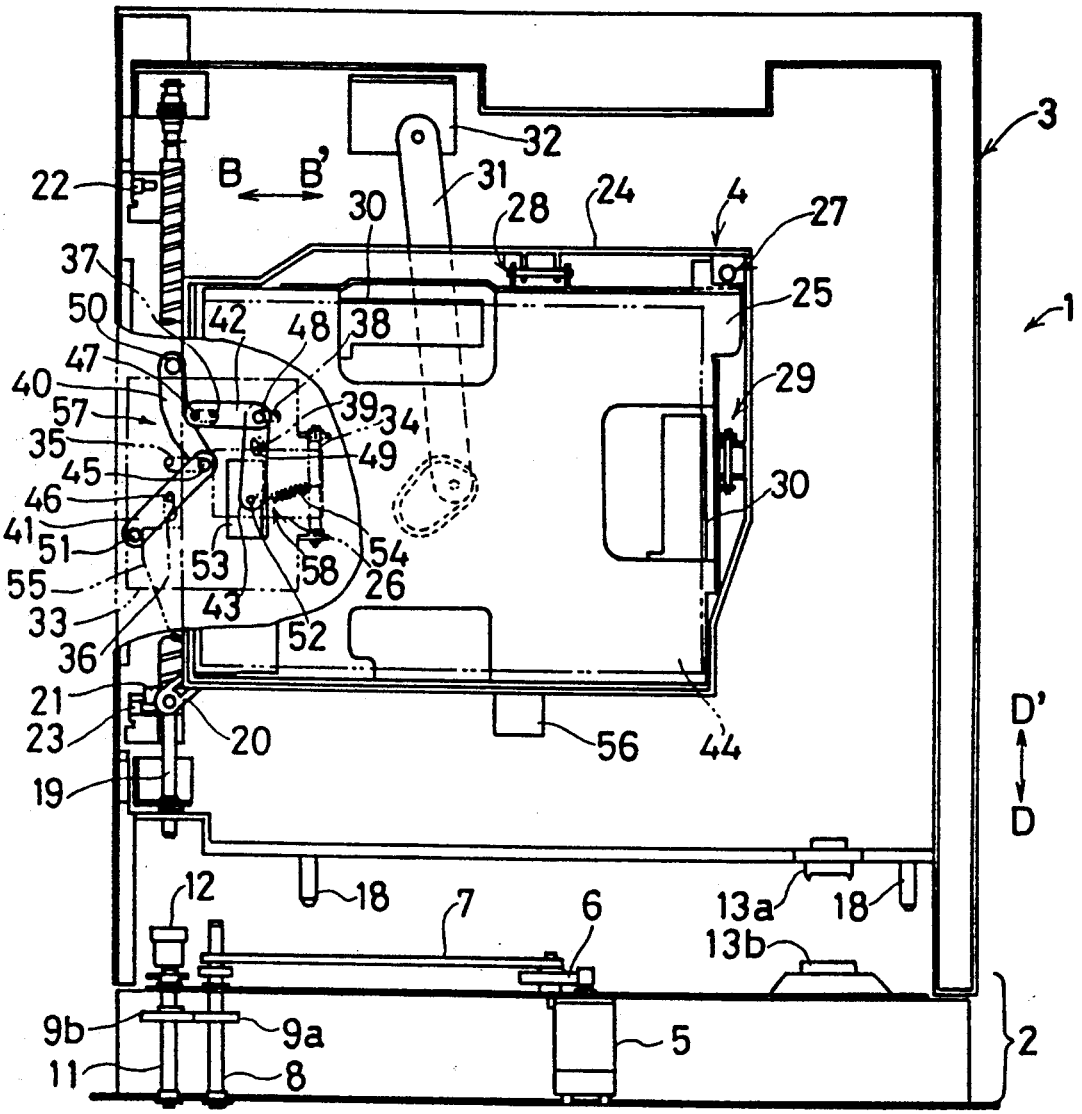
FIGS. 1 to 5 show one embodiment of the present invention.
Figure 1:
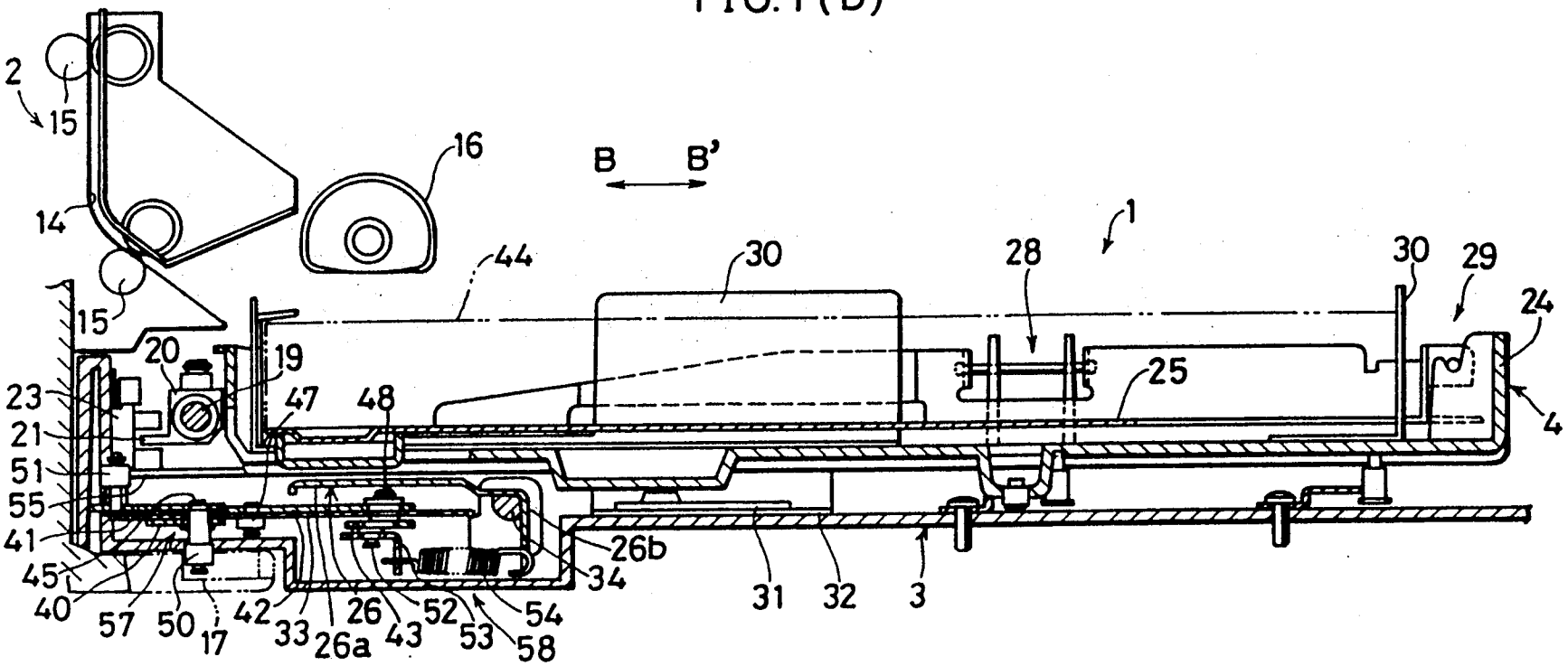
Figure 1:
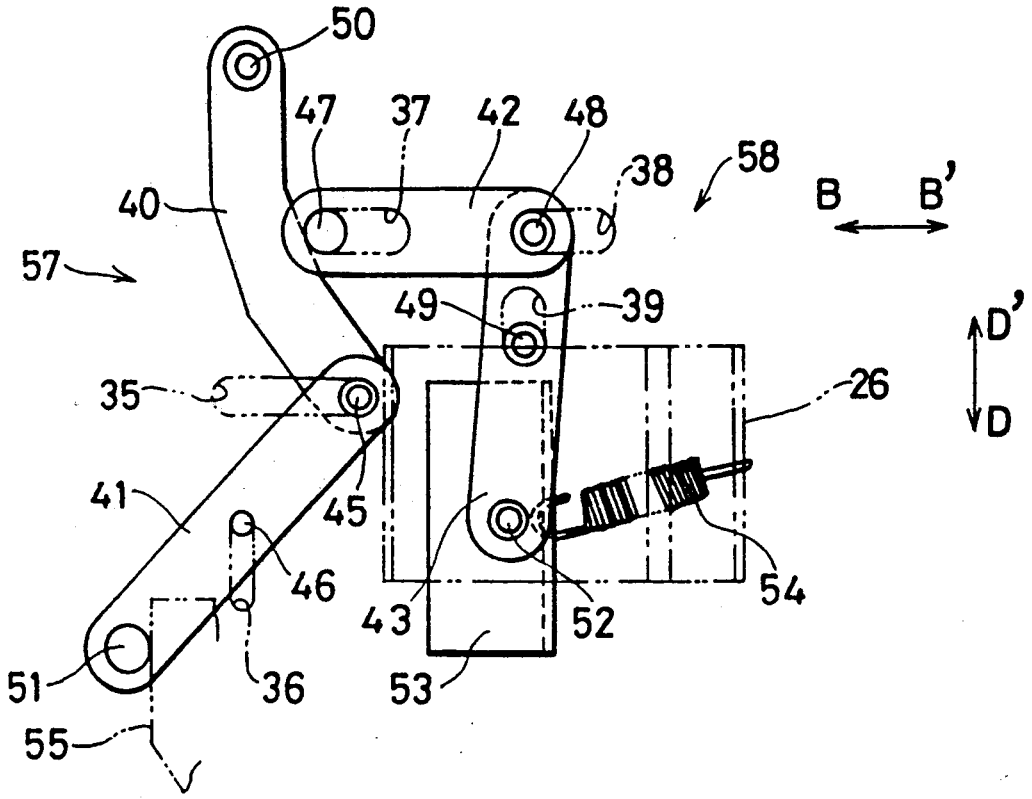

As shown in FIG. 1(*a*), a paper feeding device of the present invention comprises a rotatable paper tray unit 1. The rotatable paper tray unit 1 has a tray storing case 3 which serves as a tray storing member, and a rotatable paper tray 4 which is stored in the tray storing case 3. The rotatable paper tray unit 1 is freely attachable to and removable from a paper feeding device housing 2 in directions D—D'.

The paper feeding device housing 2 comprises a motor 5 which rotates the rotatable paper tray 4. The motive power of the motor 5 is transmitted to the rotatable paper tray unit 1 via a gear 6, a belt 7, a rotating shaft 8, a gear 9*a*, a gear 9*b*, a rotating shaft 11 and a coupling clutch 12. The paper feeding device housing 2 comprises a socket 13*b* which fits into a socket 13*a* provided in the rotatable paper tray unit 1 and also comprises, as shown in FIG. 1(*b*), a semilunar roller 16 for drawing out copy paper 44 from the rotatable paper tray 4; a paper delivery path 14; delivery rollers 15 provided along the delivery path 14; and, as will be described later, an attachment lift-up guide 17 which serves as a guide member. The attachment lift-up guide 17 guides a roller 50 of a first rotary bar 40, thereby causing a lift plate 26 to swing upwards when the rotatable paper tray unit 1 is attached to the paper feeding device housing 2.

As shown in FIG. 1(*a*), the socket 13*a* and attachment guide shafts 18 are provided toward the direction D on the tray storing case 3 of the rotatable paper tray unit 1, i.e., on an end face of the tray storing case 3 of the rotatable paper tray unit 1, the end face facing the paper feeding device housing 2. An end portion of a screw shaft 19 is disposed to project outward so as to fit into the coupling clutch 12. The screw shaft 19 is rotatable and is disposed along the directions D—D' at an end section of the tray storing case 3 toward a direction B. The direction B is the direction of orientation of a paper-feed end of the rotatable paper tray unit 1. A moving segment 20 is provided on the rotatable paper tray 4 and is screwed onto the screw shaft 19. The moving segment 20 moves above the screw shaft 19 when the screw shaft 19 rotates. The moving segment 20 is fixed to a corner section of the rotatable paper tray 4. A light interrupting plate 21 is provided in the moving segment 20. The light interrupting plate 21 is detected either by a lateral feed position sensor 22 which is disposed along the screw shaft 19, or by a longitudinal feed position sensor 23 which is disposed at a side opposite to the lateral feed position sensor 22 toward the directions D—D'. This determines whether the rotatable paper tray 4 is in a lateral feed position or in a longitudinal feed position.

As shown in FIGS. 1(*a*) and 1(*b*), the rotatable paper tray 4 has a paper holding plate 25 disposed in an outer case 24. The paper holding plate 25 is lifted up and lowered by being driven by the lift plate 26 which serves as a paper holding plate driving member. The paper holding plate 25 is supported at a supported section 27 so as to swing freely in the outer case 24. The supported section 27 is provided at a corner section thereof. End sections of the paper holding plate 25 that are located toward a direction B' are supported to be rotatively free and to be freely slidable upward and downward at, respectively, a lateral feed supported section 28 and a longitudinal feed supported section 29. The direction B, is the direction opposite to the direction (direction B) in which the copy paper 44 is fed. Two paper position setting plates 30 are provided in the outer case 24 for setting a position therein of the copy paper 44. Further, one end section of a rotary supporting plate 31 is coupled to a bottom surface of the outer case 24 and the other end section of the rotary supporting plate 31 is coupled to a mounting plate 32 disposed on the tray storing case 3. A plate-shaped longitudinal feed lift-up guide 55 is provided in the outer case 24 on a portion that forms an end section toward the direction B, i.e., toward the paper feed direction, in the case where the rotatable paper tray 4 is in the longitudinal feed position. A plate-shaped lateral feed lift-up guide 56 is provided in the outer case 24 on a portion that forms an end section toward the direction B, i.e., toward the paper feed direction, in the case where the rotatable paper tray 4 is in the lateral feed position. The longitudinal feed lift-up guide 55 serves as a longitudinal feed lift-up guide member and the lateral feed lift-up guide 56 serves as a lateral feed lift-up guide member.

A driving mechanism supporting plate 33 is provided in the tray storing case 3 on a portion located toward the direction B, between the tray storing case 3 and the rotatable paper tray 4. A lift plate supporting shaft 34 is provided substantially parallel to the screw shaft 19 on an end section of the driving mechanism supporting plate 33, the end section being located toward the direction B'. The lift plate 26 is attached to the lift plate supporting shaft 34. The lift plate 26 comprises an extending section 26a which extends in the direction B from the lift plate supporting shaft 34, and an overhanging section 26b which projects downwards from an end section of the extending section 26a, the end section being located toward the direction B'.

As shown in FIG. 1(*c*), long, narrow holes as first to fifth guide slits 35–39 are formed in the driving mechanism supporting plate 33. A coupling pivot 45 is inserted into the first guide slit 35. The coupling pivot 45 couples respective end sections of the first rotary bar 40 and a second rotary bar 41. The first rotary bar 40 serves as a first driven member and the second rotary bar 41 serves as a second driven member. A guide pivot 46 is inserted into the second guide slit 36, the guide pivot 46 being disposed in a vicinity of a central section of the second rotary bar 41. The roller 50 is provided on the other end section of the first rotary bar 40, the roller 50 being guided by the attachment lift-up guide 17 provided in the paper feeding device housing 2. A roller 51 is provided on the other end section of the second rotary bar 41, the roller 51 being guided by the longitudinal feed lift-up guide 55 or the lateral feed lift-up guide 56 provided in the outer case 24. A driving force applying mechanism 57 thus consists of: the first and second guide slits 35 and 36; the first rotary bar 40 and the second rotary bar 41; the coupling pivot 45; the guide pivot 46; and the rollers 50 and 51.

A guide pivot 47 is inserted into the third guide slit 37, the guide pivot 47 being provided on an end section of a third rotary bar 42. A coupling pivot 48 is inserted into the fourth guide slit 38. The coupling pivot 48 couples end sections of the third rotary bar 42 and a fourth rotary bar 43. A guide pivot 49 is inserted into the fifth guide slit 39, the guide pivot 49 being disposed in the fourth rotary bar 43. The guide pivot 47 is pushed by the first rotary bar 40. As a result, the third rotary bar 42 slides on being guided by the third guide slit 37 and the fourth guide slit 38. Accompanying this movement of the third rotary bar 42, the fourth rotary bar 43 slides on being guided by the fourth guide slit 38 and the fifth guide slit 39. A spring coupling plate 53 is coupled to an end section of the fourth rotary bar 43 by a coupling pivot 52 so as to be rotatively free. A bottom end section of the spring coupling plate 53 is coupled via a spring 54 to the overhanging section 26b of the lift plate 26. Consequently, a movement of the fourth rotary bar 43 is transmitted to the lift plate 26 via the spring coupling plate 53 and the spring 54, whereby the lift plate 26 swings. The paper holding plate 25 is thus lifted up or lowered. A driving force transmission mechanism 54 is accordingly composed of: the third to fifth guide slits 37–39; the third and fourth rotary bars 42 and 43; the guide pivots 47 and 49; the coupling pivots 48 and 52; the spring coupling plate 53; and the spring 54.

With the above arrangement, in a case where, as shown in FIG. 1(*a*), the rotatable paper tray 4 is in the longitudinal feed position and the rotatable paper tray unit 1 has been removed from the paper feeding device housing 2 in the direction D', then, as shown in FIGS. 1(*b*) and 1(*c*) as well, the roller 51 of the second rotary bar 41 is pushed in the direction B by the longitudinal feed lift-up guide 55. Accordingly, the guide pivot 46 shifts in the second guide slit 36 in the direction D' and the coupling pivot 45 shifts in the first guide slit 35 in the direction B'. At this time, since the roller 50 of the first rotary bar 40 is not being pushed by the attachment lift-up guide 17, the first rotary bar 40 is rotatively free. The fourth rotary bar 43 is pulled in the direction B' by the spring 54 via the spring coupling plate 53, and the guide pivot 49 shifts in the fifth guide slit 39 in the direction D. Accordingly, the coupling pivot 48 shifts in the fourth guide slit 38 in the direction B and the guide pivot 47 of the third rotary bar 42 shifts in the third guide slit 37 in the direction B. In this state, a pulling force is not exerted on the lift plate 26 by the spring 54. Consequently, as shown in FIG. 1(*b*), the lift plate 26 becomes substantially horizontal and the paper holding plate 25 stays in a lowered position.

Figure 2A:
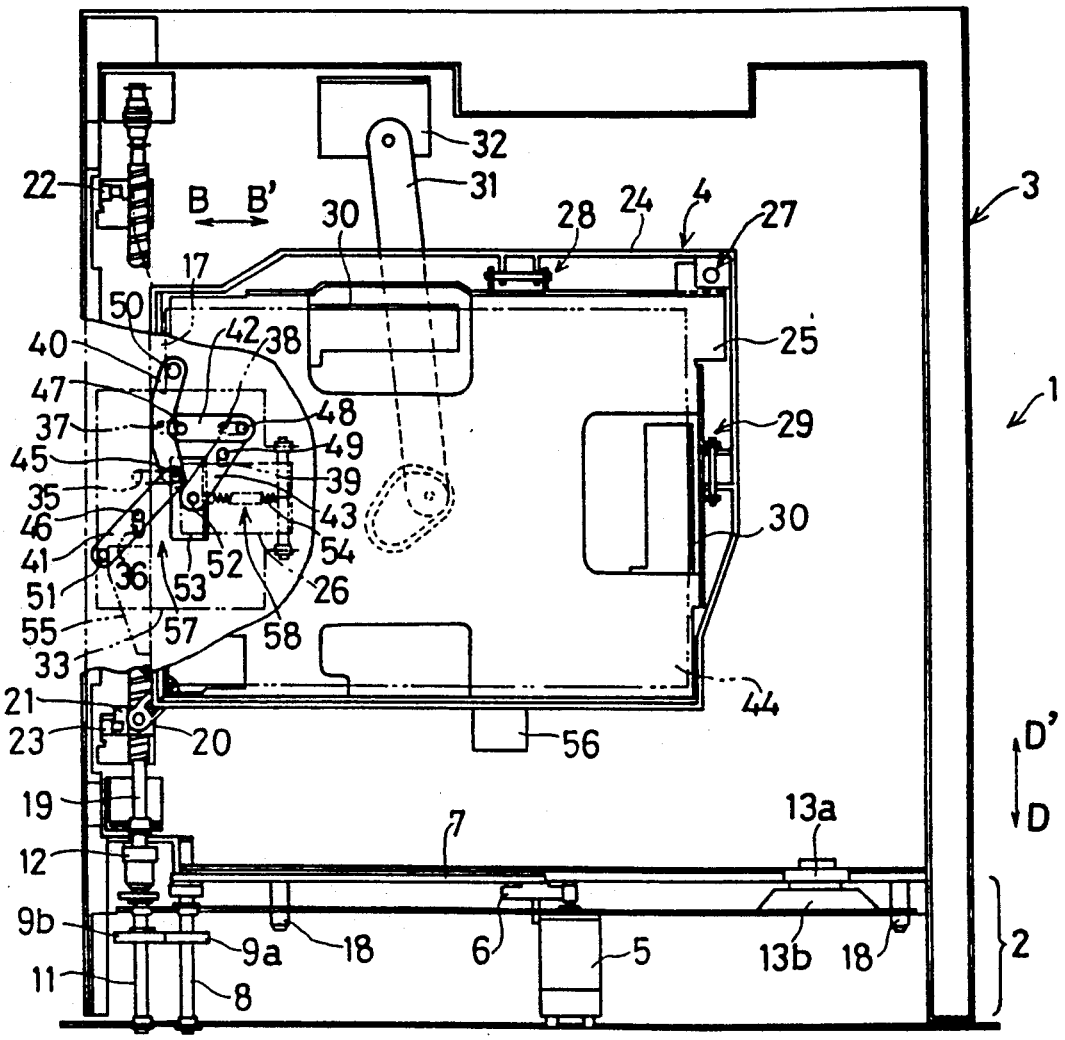
Figure 2B:
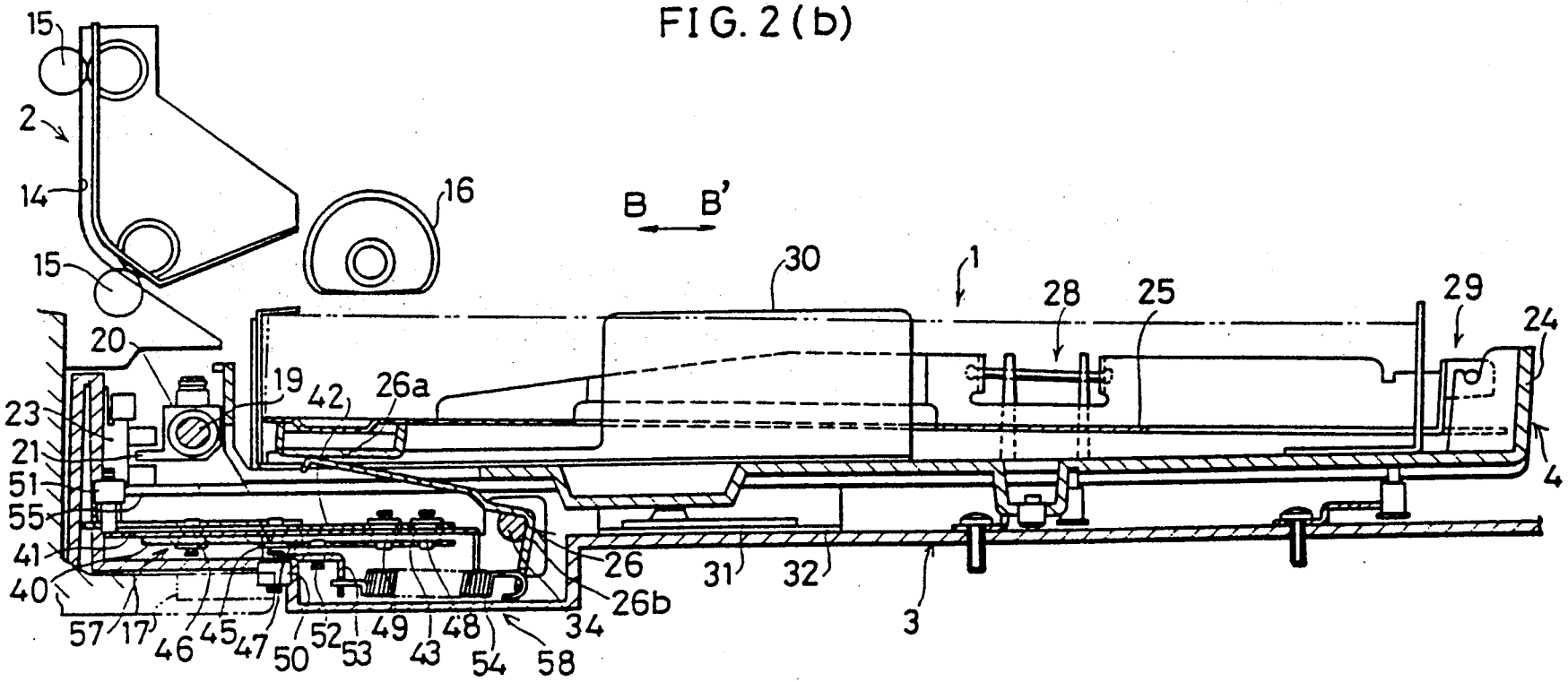
Figure 2:
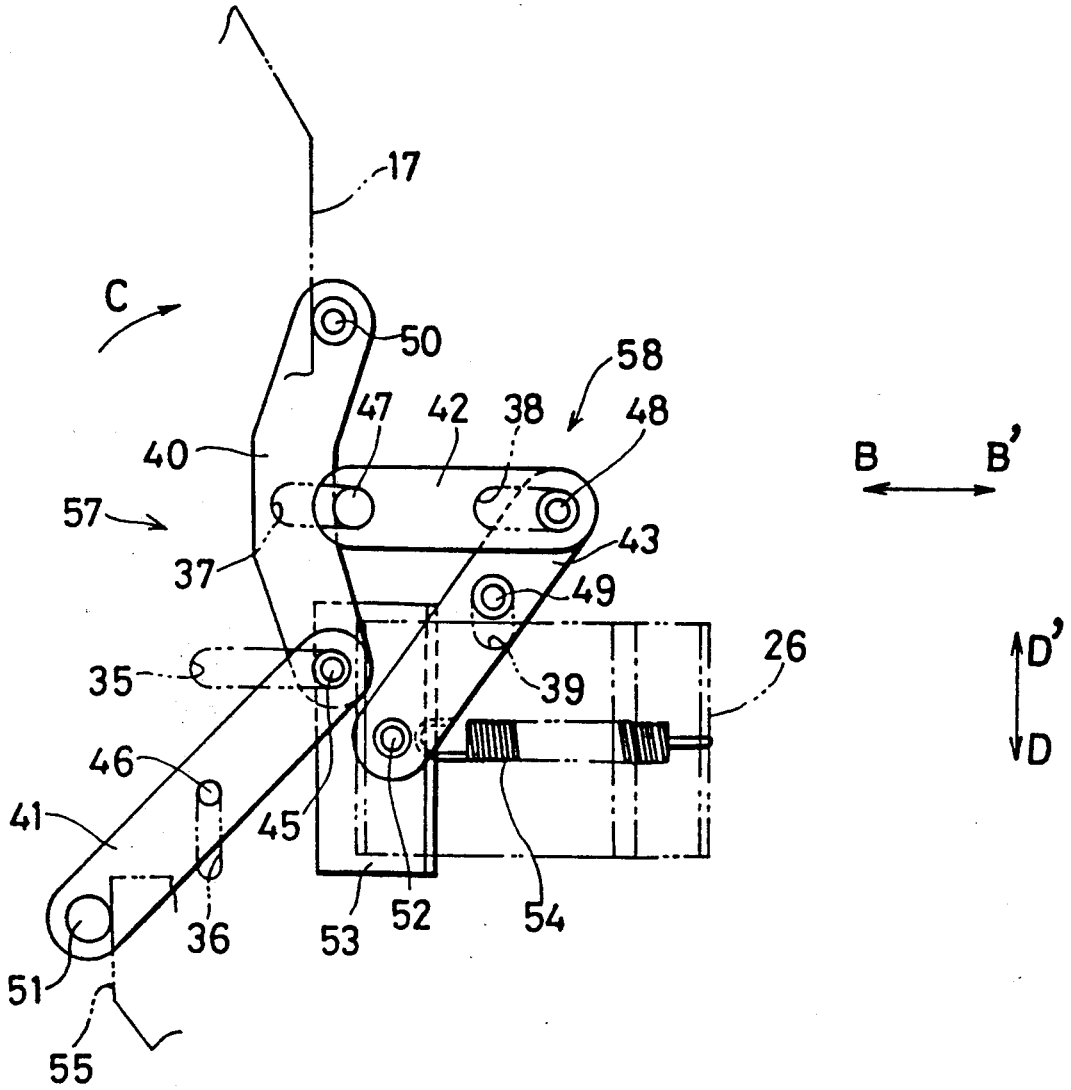

When the rotatable paper tray unit 1 is attached to the paper feeding device housing 2, as shown in FIGS. 2(*a*), 2(*b*) and 2(*c*), the roller 50 shifts along the attachment lift-up guide 17 and only the first rotary bar 40 rotates in a direction C, the second rotary bar 41 not moving at all. Accordingly, the guide pivot 47 of the third rotary bar 42 is pushed by the first rotary bar 40 and shifts in the third guide slit 37 in the direction B'. The coupling pivot 48 therefore also shifts in the fourth guide slit 38 in the direction B'. Consequently, the guide pivot 49 of the fourth rotary bar 43 shifts in the fifth guide slit 39 in the direction D', causing the coupling pivot 52 to swing in the direction C, which in turn causes the spring coupling plate 53 to be pushed in the direction B. Thus, the overhanging section 26b of the lift plate 26 is thereby pulled in the direction B by the spring 54 and the lift plate 26 swings upward, causing the paper holding plate 25 to be lifted up to the paper-feed position. Paper feeding can then be carried out by the semilunar roller 16. Whereas, when the rotatable paper tray unit 1, which now has the paper holding plate 25 lifted up to the paper-feed position, is removed from the paper feeding device housing 2, a force is no longer exerted by the attachment lift-up guide 17 on the roller 50. This causes the lift plate 26 to swing downwards due to the weight of the paper holding plate 25 whereon the copy paper 44 is stacked, whereby the paper holding plate 25 is lowered.

Figure 3:
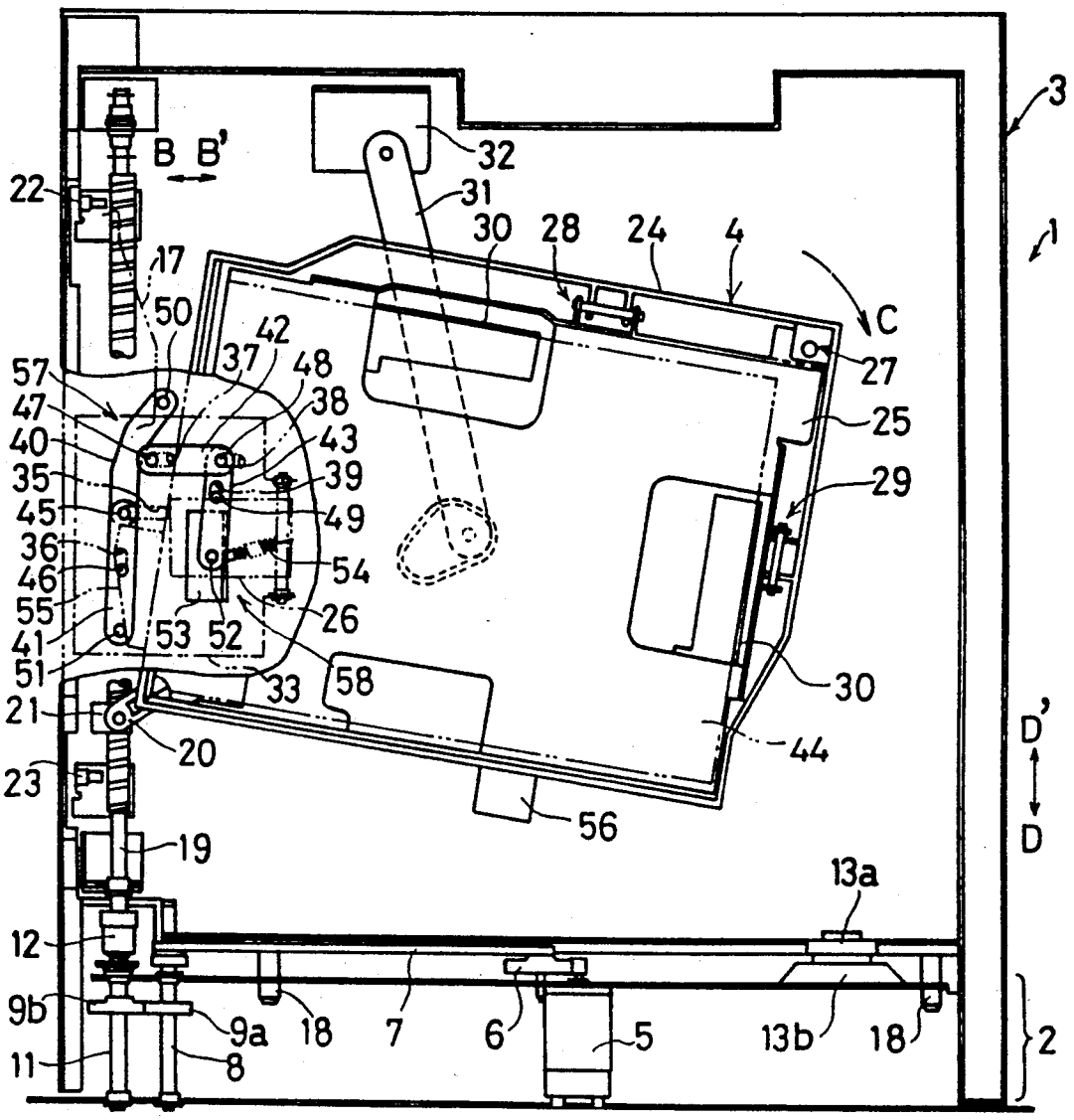

In a case where the rotatable paper tray 4 rotates from the longitudinal feed position shown in FIG. 2(*a*) to the lateral feed position, as shown in FIG. 3, the moving segment 20 shifts in the direction D' with a rotation of the screw shaft 19, the rotation taking place due to the motor 5. Accordingly, the rotatable paper tray 4 rotates in the direction C. Here, the longitudinal feed lift-up guide 55 ceases to press against the roller 51 since the longitudinal feed lift-up guide 55 shifts in a direction away from the roller 51 with the rotation of the rotatable paper tray 4. As a result, the first rotary bar 40 ceases to press against the guide pivot 47 of the third rotary bar 42 and the lateral section 26a of the lift plate 26 is lowered due to the weight of the paper holding plate 25 whereon the copy paper 44 is stacked. The downward swing of the lift plate 26 causes the spring coupling plate 53 to be pulled in the direction B' via the spring 54. This in turn causes the guide pivot 49 of the fourth rotary bar 43 to shift in the fifth guide slit 39 in the direction D and the coupling pivot 48 to shift in the fourth guide slit 38 in the direction B. Consequently, the third rotary bar 42 shifts in the direction B and the guide pivot 47 thereby shifts in the third guide slit 37 in the direction B and presses in the direction B against the first rotary bar 40. This causes the coupling pivot 45 to shift in the first guide slit 35 in the direction B, resulting in a state shown in FIG. 3.

Figure 4:
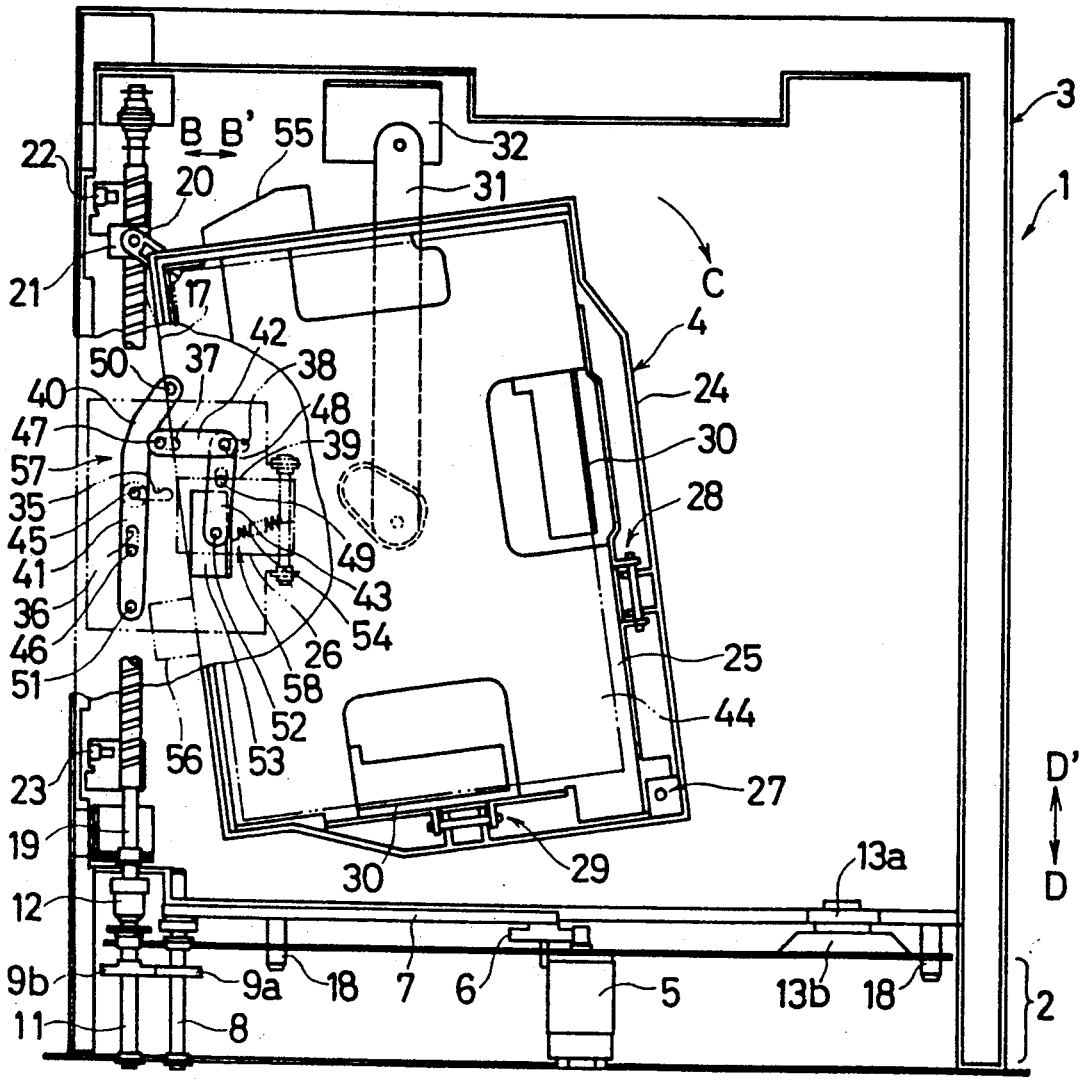
Figure 4:
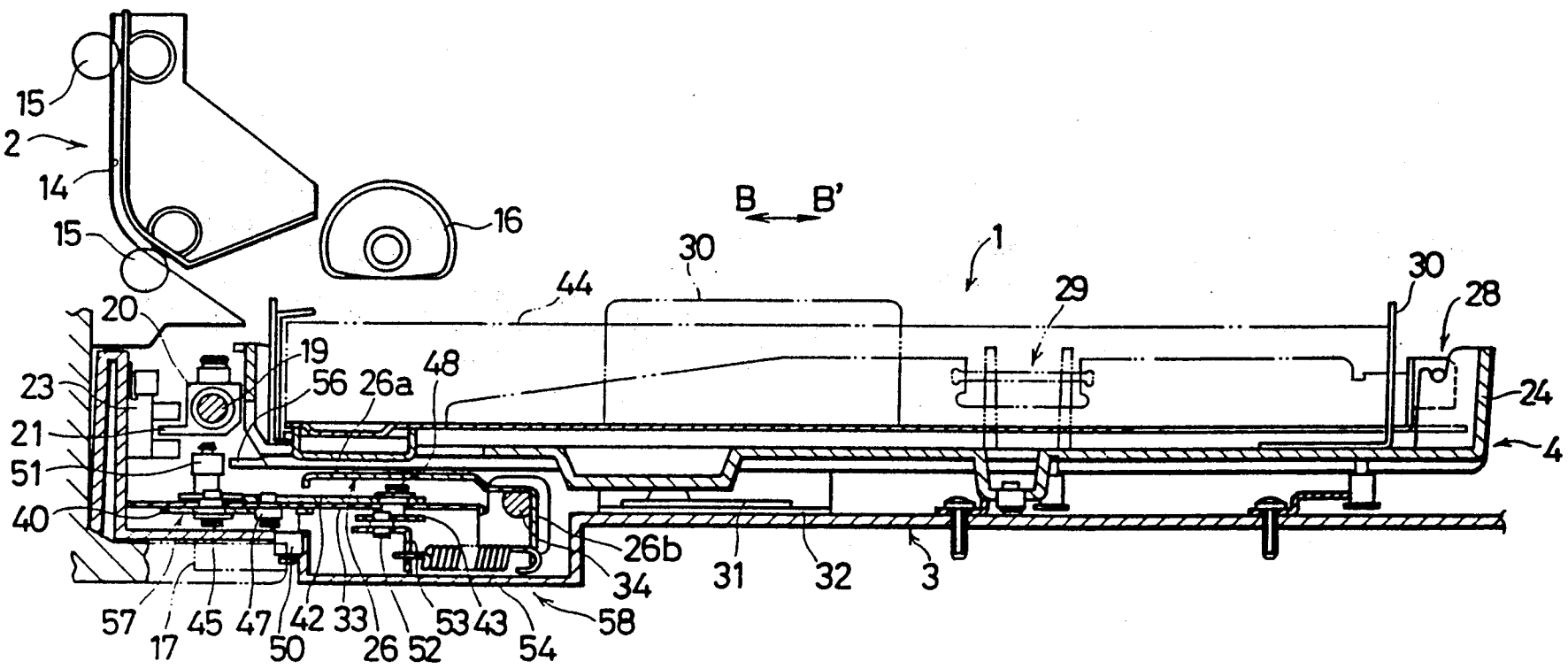
Figure 4:
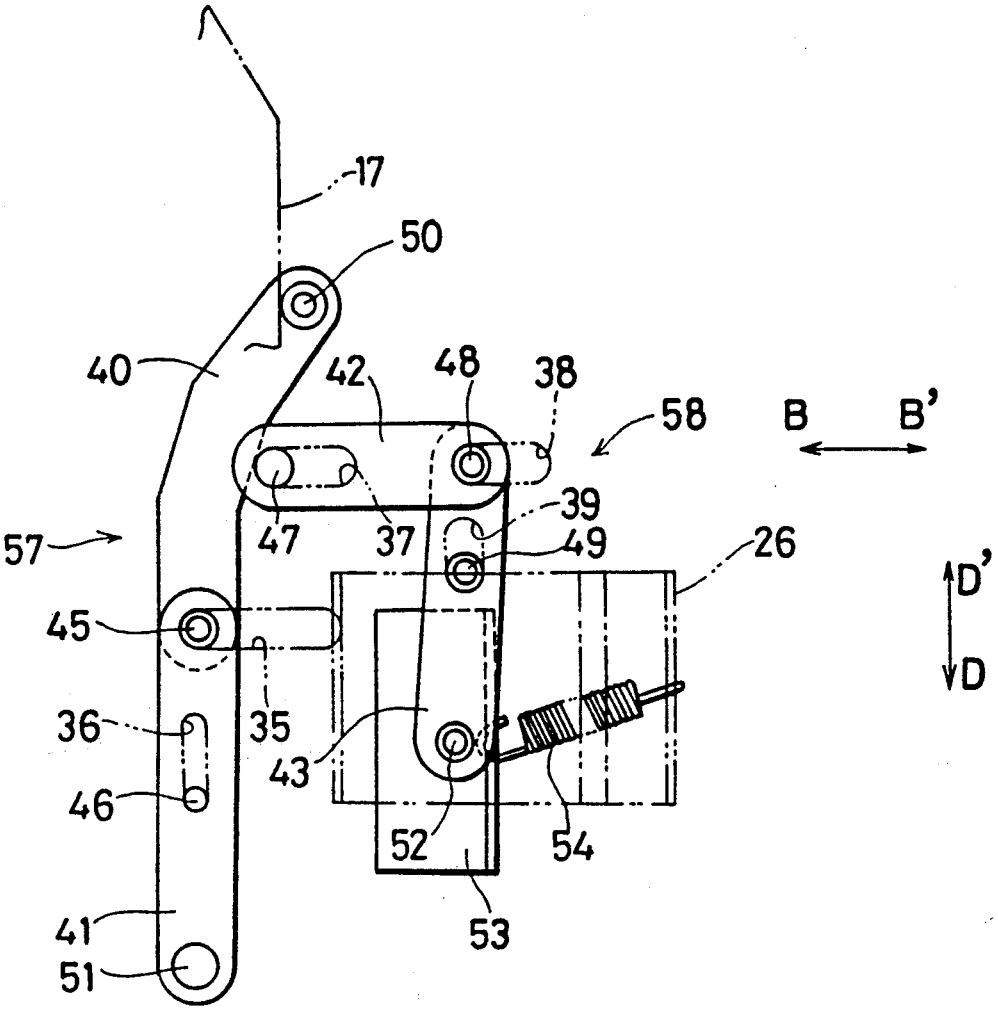
Figure 5:
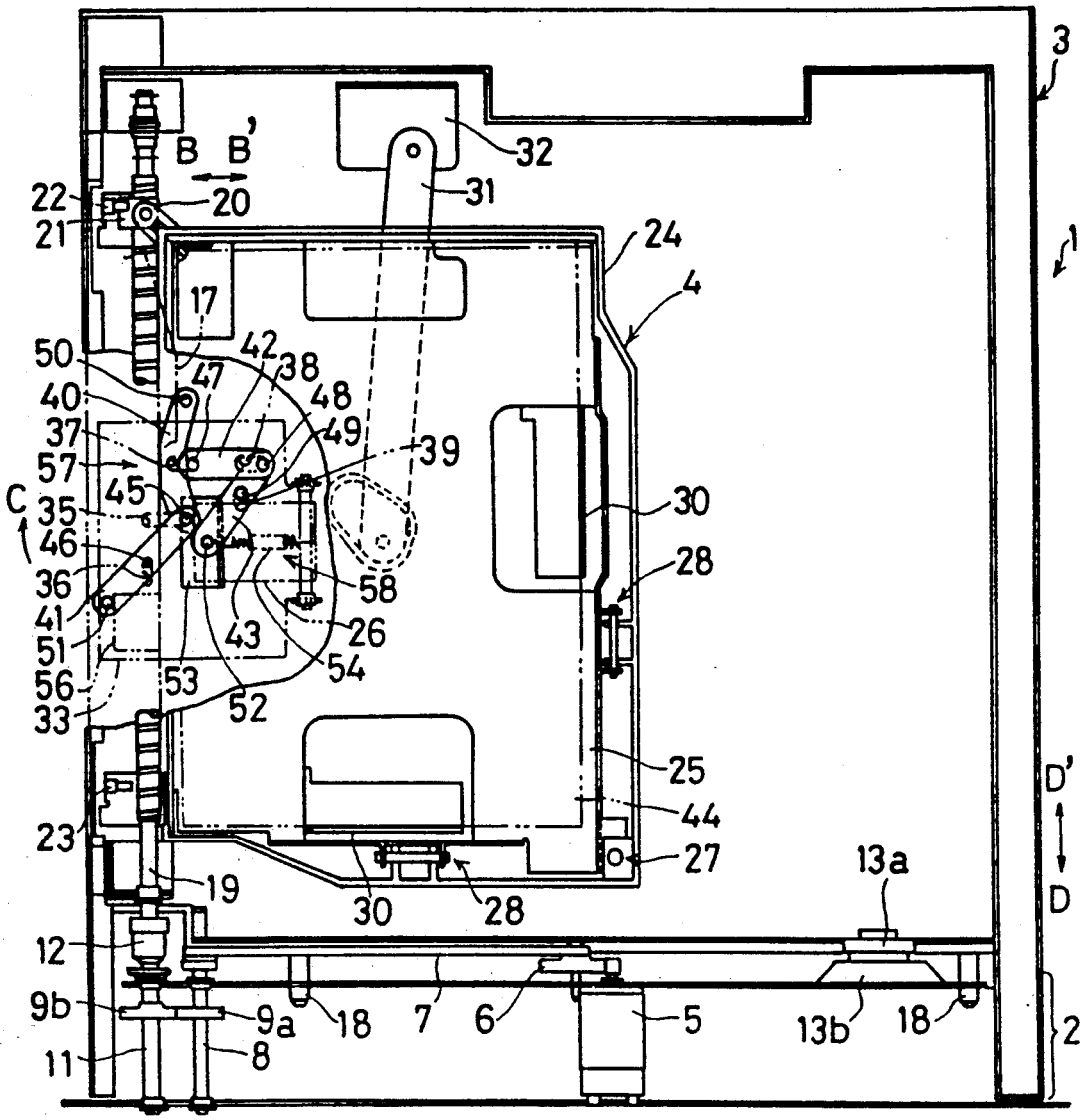

The rotatable paper tray 4 rotates further and a state as shown in FIGS. 4(*a*)–4(*c*) is reached. When the light interrupting plate 21 is detected by the lateral feed position sensor 22, the motor 5 stops and, as shown in FIG. 5, the rotatable paper tray 4 reaches the lateral feed position. At this time, the lateral feed lift-up guide 56 presses against the roller 51 of the second rotary bar 41 causing the second rotary bar 41 to swing in the direction C, which in turn causes the guide pivot 46 to shift in the second guide slit 36 in the direction D' and the coupling pivot 45 to shift in the first guide slit 35 in the direction B'. As a result, the first rotary bar 40 presses against the guide pivot 47 of the third rotary bar 42, causing the guide pivot 47 to shift in the third guide slit 37 in the direction B', and the coupling pivot 48 to shift in the guide slit 38 in the direction B'. Accompanying this, the guide pivot 49 of the fourth rotary bar 43 shifts in the fifth guide slit 39 in the direction D' and the coupling pivot 52 swings in the direction C, thereby pulling the spring coupling plate 53 in the direction B. Consequently, the spring 54 pulls the overhanging section 26*b* of the lift plate 26 in the direction B, thereby causing the lift plate 26 to swing upwards. This in turn causes the paper holding plate 25 to be lifted up to the paper-feed position. Whereas, when the rotatable paper tray unit 1, which now has the paper holding plate 25 lifted up to the paper-feed position, is removed from the paper feeding device housing 2, as in the case where the rotatable paper tray 4 is in the longitudinal feed position, a force is no longer exerted by the attachment lift-up guide 17 on the roller 50, thereby causing the paper holding plate 25 to be lowered.

Another embodiment of the present invention is described hereinbelow, referring to FIGS. 6 to 11.

For the sake of convenience, members having the same function as in the aforementioned embodiment will be designated by the same numerals and their description will be omitted.

Figure 6:
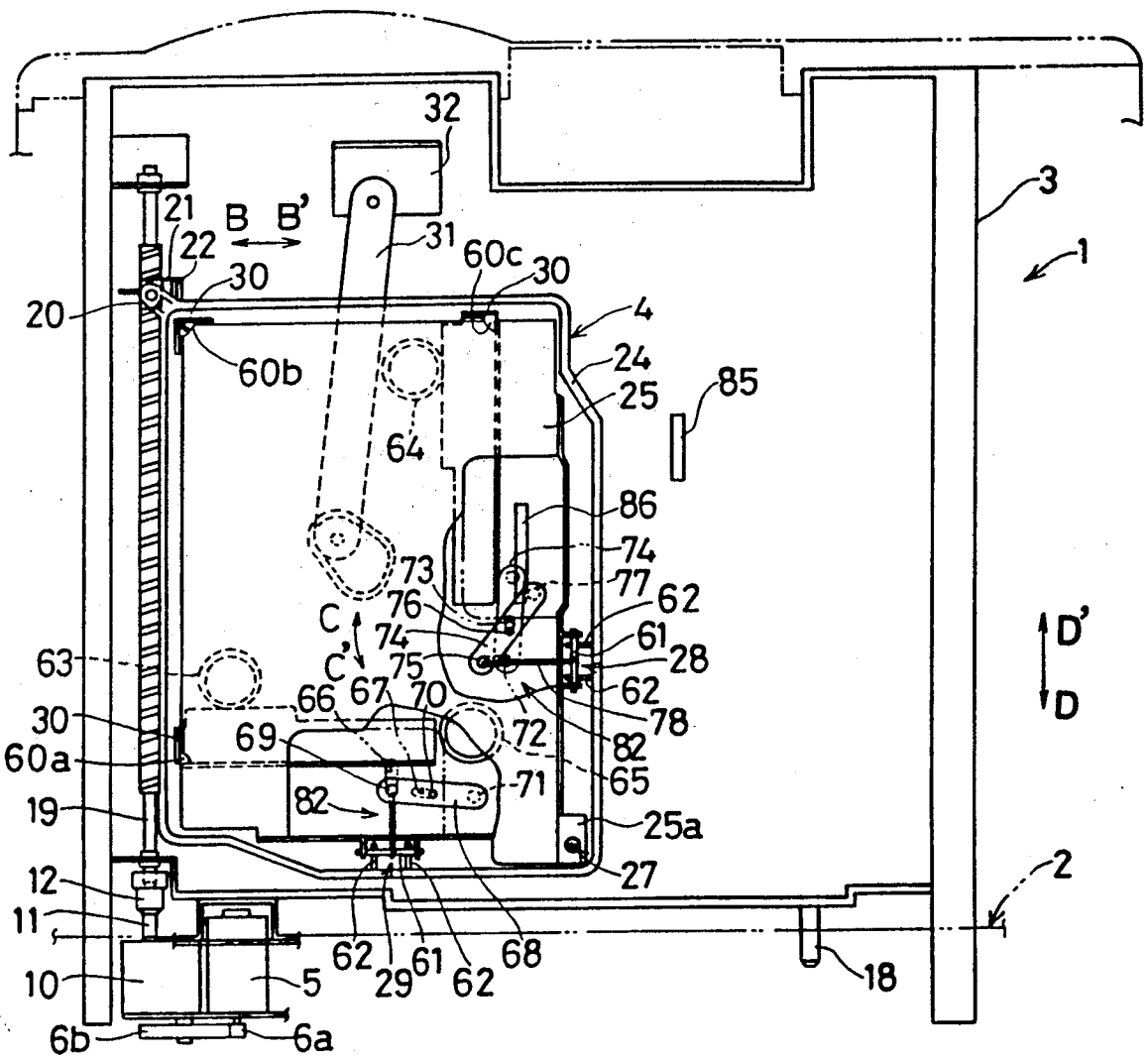
FIGS. 6 to 11 show another embodiment of the present invention.

As shown in FIG. 6, a paper feeding device housing 2 of the present invention comprises a motor 5 which rotates a rotatable paper tray 4, the motive power of the motor 5 being transmitted to a screw shaft 19 provided on a rotatable paper tray unit 1 via gears 6*a* and 6*b*, a decelerating mechanism 10, a rotating shaft 11 and a coupling clutch 12.

Figure 8:
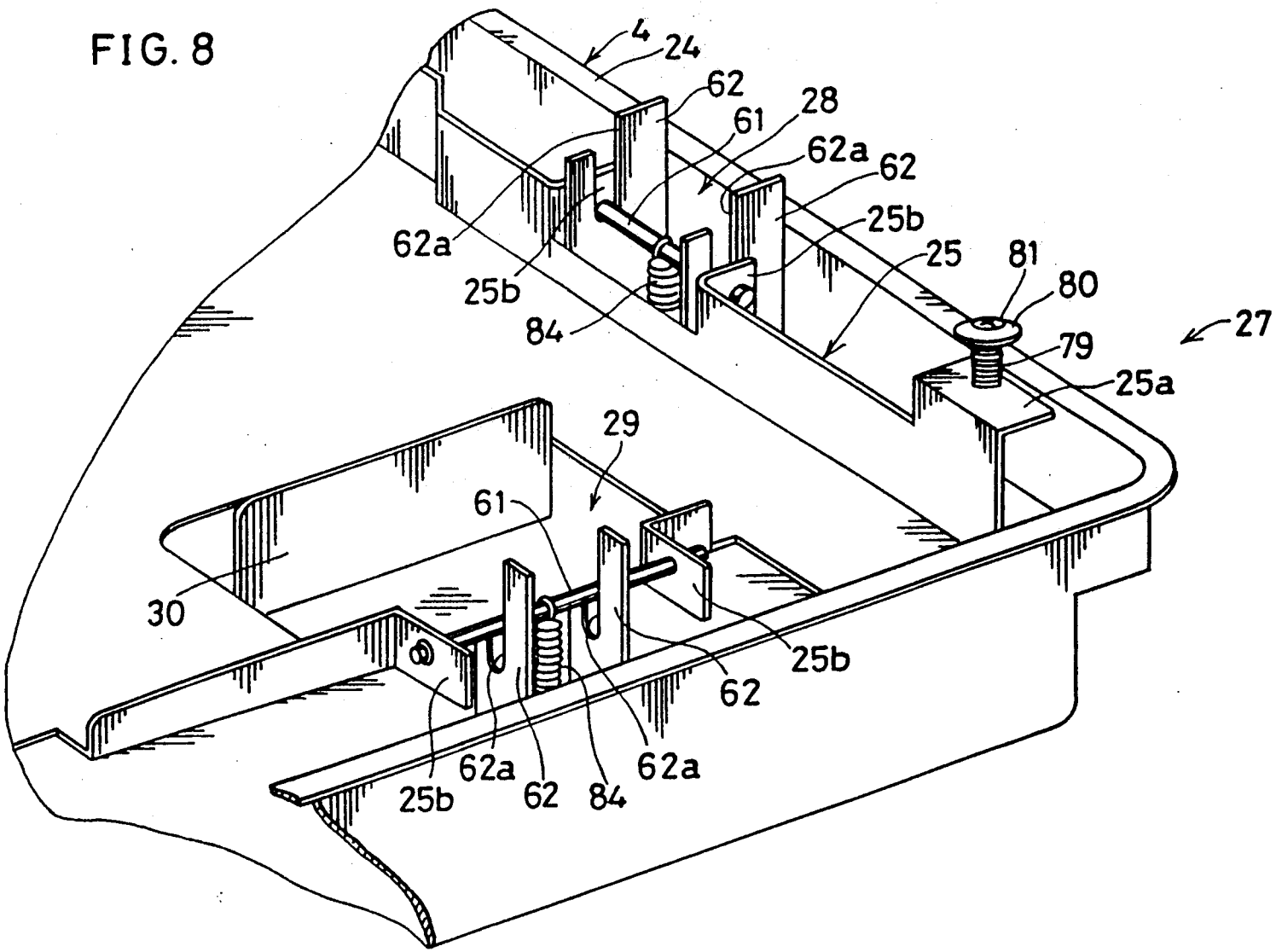

The rotatable paper tray 4 comprises a paper holding plate 25 in an outer case 24. The outer case 24 serves as a paper holding plate storing member. The paper holding plate 25 is supported by the outer case 24 at a supported section 27, the supported section 27 being provided on a corner section located diagonally opposite to a moving segment 20. As shown in FIG. 8, the supported section 27 is composed of: a rising protruding segment 25*a* protruding from the paper holding plate 25; a coiled spring 79 and a washer 80 disposed above the rising protruding segment 25*a*; and a supporting screw 81 which is screwed into the outer case 24 through the washer 80, the coiled spring 79 and the rising protruding segment 25*a*. End sections (located on a side lying toward a direction B' opposite to a direction B, the direction B being a paper feed direction during longitudinal or lateral feed) of the paper holding plate 25 are supported respectively at a lateral feed supported section 28 and a longitudinal feed supported section 29 so as to be slidable in up-down directions. That is, in the lateral and longitudinal feed supported sections 28 and 29, rotary pivot rods 61 serving respectively as a lateral feed junction section and a longitudinal feed junction section are provided between opposing segments 25*b* which are provided on the paper holding plate 25. The rotary pivot rods 61 are supported by openings 62*a* of rod supporting members 62 which are disposed opposite to each other. The rotary pivot rods 61 are supported so as to be slidable and rotatively free.

Figure 11:
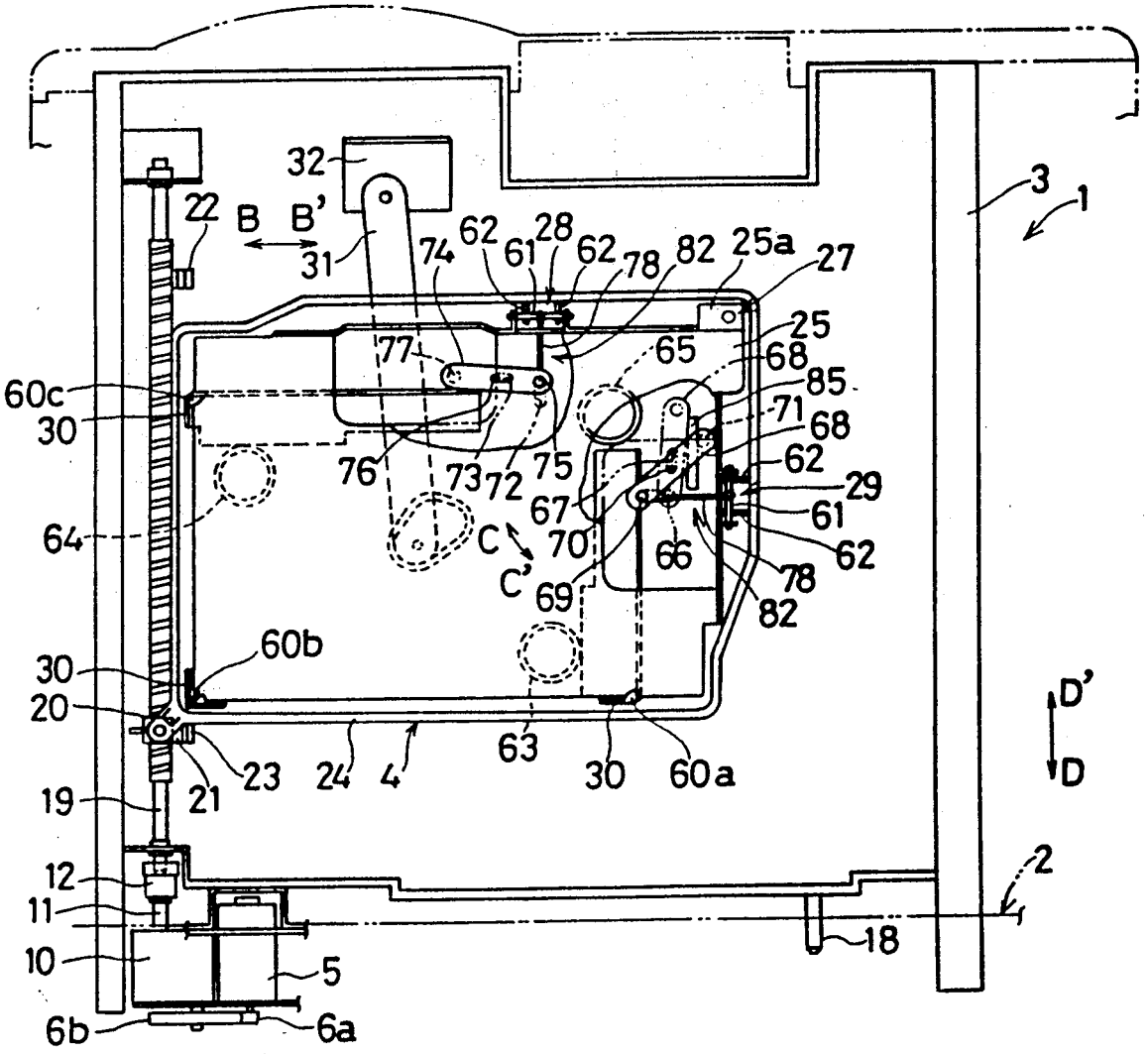

As shown in FIG. 6, three paper position setting plates 30 are provided in the outer case 24 of the rotatable paper tray 4 for setting paper position. A clip member 60*a* is provided on a portion of one of the paper position setting plates 30 located on a corner section toward a direction D when the rotatable paper tray 4 is in a lateral feed position. A fork-shaped clip member 60*b* is provided on a portion of another of the paper position setting plates 30. This paper position setting plate 30 is located toward a direction D', i.e., on the portion corresponding to the common-corner section. Similarly, as shown in FIG. 11, a clip member 60*c* is provided on a portion of the third paper position setting plate 30 which is located on a corner section on a paper-feed end toward the direction D' when the rotatable paper tray 4 is in a longitudinal feed position. Each of the clip members 60*a*–60*c* serves to prevent double feeding or improperly angled feeding of copy paper by regulating corner sections of the copy paper. The clip members 60*a*–60*c* are provided on the paper position setting plates 30 so as to be freely slidable in an up-down direction.

Figure 7:
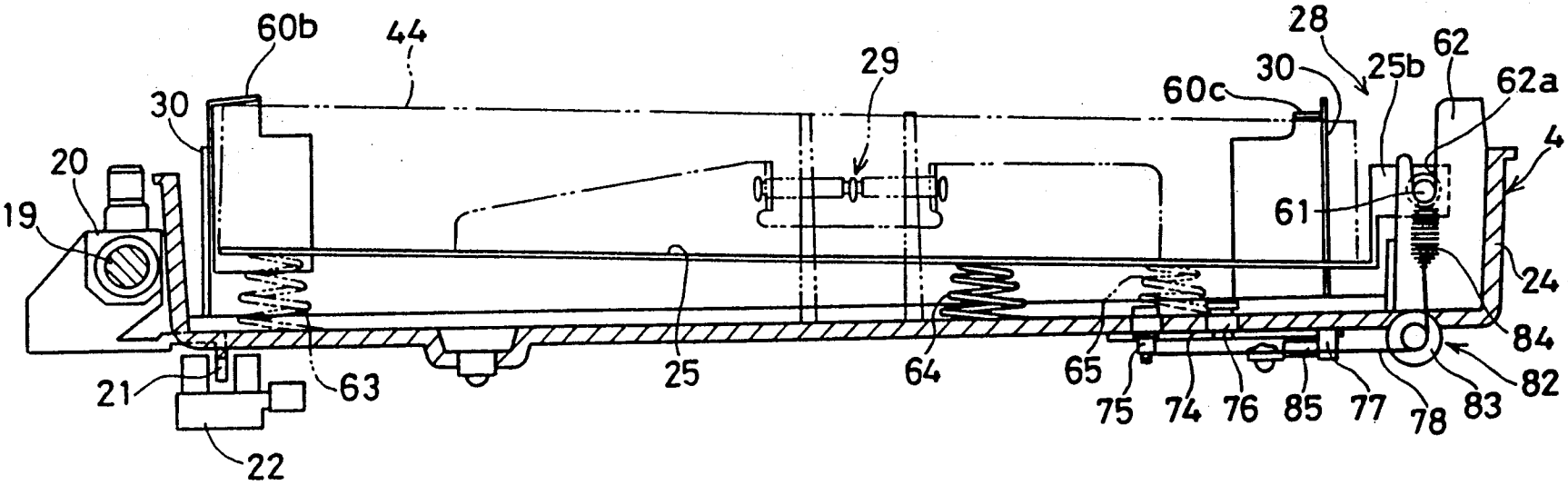
Figure 10:
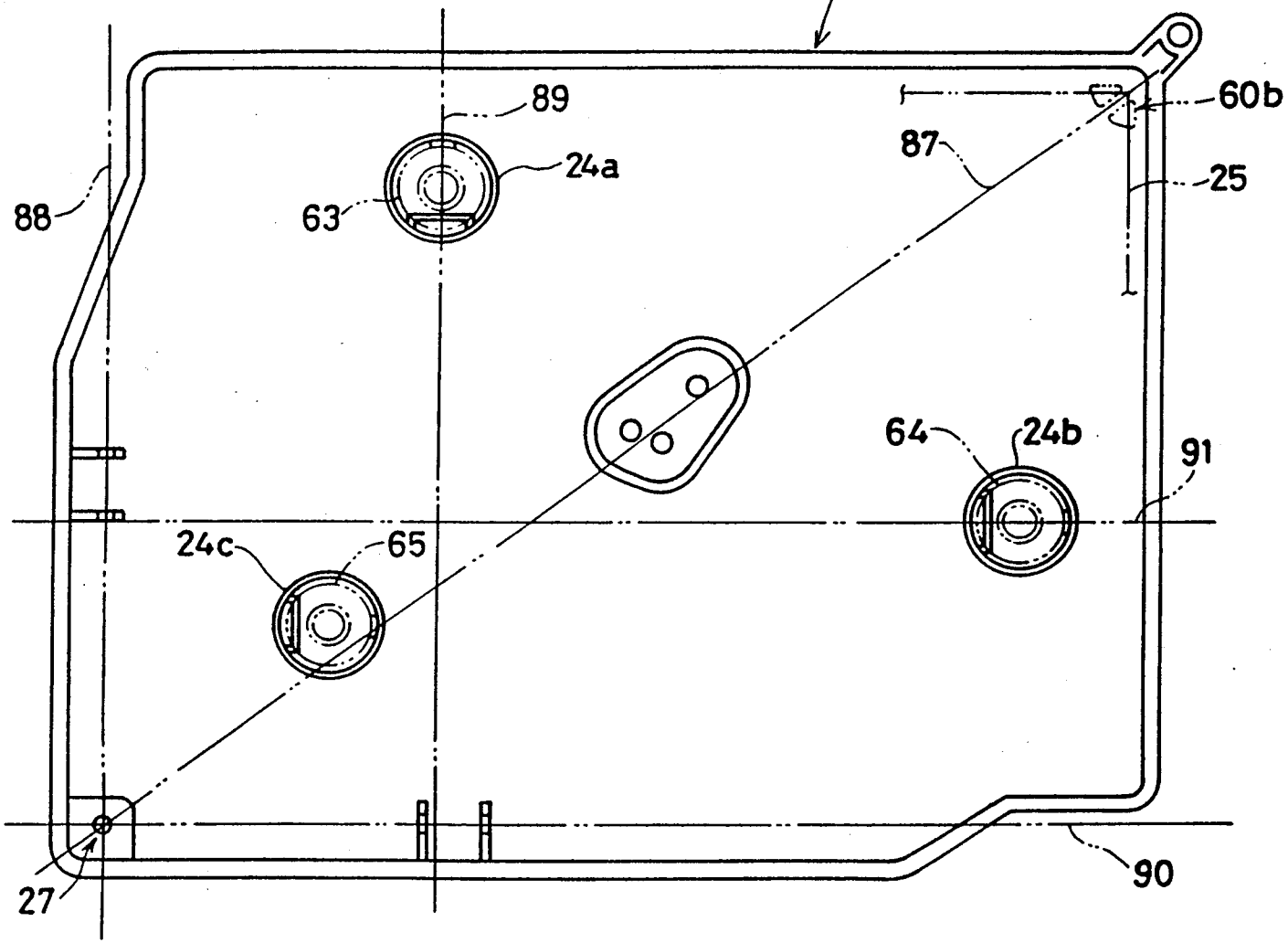

As shown in FIG. 7, three conical compression springs are provided as coiled springs 63–65 between the outer case 24 and the paper holding plate 25. These coiled springs 63–65 push the paper holding plate 25 upwards. As shown in FIG. 10, the coiled springs 63–65 are fixed on spring mounting sections 24*a*–24*c* which are provided on the outer case 24. The coiled spring 63 serves as a first elastic member and is provided under a portion of the paper holding plate 25, the portion being located on one side of an imaginary straight line 87 drawn between the clip member 60*b* and the supported section 27. The coiled spring 64 serves as a second elastic member and is provided under a portion located on the other side of the imaginary straight line 87. The coiled spring 65 serves as a third elastic member and is provided under a portion close to the supported section 27 of the paper holding plate 25, the portion being formed by the intersection of imaginary straight lines 89 and 91. The imaginary straight line 89 passes through the center of the coiled spring 63 and is parallel to an imaginary straight line 88 which extends from the supported section 27 toward a paper feed direction oriented toward the coiled spring 63. The imaginary straight line 91 passes through the center of the coiled spring 64 and is parallel to an imaginary straight line 90 which extends from the supported section 27 toward a paper feed direction oriented toward the coiled spring 64. Furthermore, regarding the arrangement of the coiled springs 63 and 64, it is desirable that the coiled spring 63 be disposed, as shown in FIG. 6, under a portion located toward the direction B and the direction D when the rotatable paper tray 4 is in the lateral feed position; and the coiled spring 64 be disposed, as shown in FIG. 11, under a portion located toward the direction B and the direction D' when the rotatable paper tray 4 is in the longitudinal feed position. This arrangement permits the paper holding plate 25 to be supported more effectively.

Results of tests performed for selecting each of the coiled springs 63–65 are discussed hereinbelow.

Springs I–III having characteristics as described in Table 1 were selected as springs to be tested for setting the coiled springs 63–65. Regarding the "Length of Spring" column in Table 1, lengths $l_1$ and $l_2$ corresponding to "Paperless" and "250 Sheets" refer respectively to a length of the spring disposed on a paper-feed end when there is no copy paper on the paper holding plate 25 and to a length when 250 sheets of copy paper are set on the paper holding plate 25. The column "Force Due to Spring" refers to forces exerted by each of the springs I–III on the paper holding plate 25 when they are respectively set to the lengths $l_1$ and $l_2$.

TABLE 1

| Length of Spring | Force Due to Spring (g) I | II | III |
|---|---|---|---|
| Paperless $l_1$ = 40.4 mm | 250 | 400 | 200 |
| 250 Sheets $l_2$ = 15.3 mm | 1000 | 1400 | 650 |

As is evident from Table 1, the spring II is the strongest, the spring III is the weakest and the spring I has a medium strength between those of the springs II and III.

Table 2 shows results of a test conducted using the springs I–III as the coiled springs 63–65. Sections P, Q and R in the column "Location of Spring" correspond respectively to the spring mounting sections 24a–24c in the outer case 24. "Force Exerted on Paper Feed Roller" is a force exerted on a paper feed roller of the paper holding plate 25 by different combinations of the springs I–III, both in a paperless state and when 250 sheets of copy-paper are stacked on the paper holding plate 25. The force in each case is taken to be exerted on the clip members 60a–60c which are disposed toward the paper-feed end. The value of the "Force Exerted on Paper Feed Roller" should ideally lie within the range 300–400 g in the present embodiment since within this range the value remains substantially constant from the state when the 250 sheets are placed on the paper holding plate 25 to the paperless state, which prevents double feeding or improperly angled feeding of the copy paper. A4 paper having a weight of 70–80 g/m$^2$ was used as the copy paper.

TABLE 2

| Example No. | Location of Spring P | Q | R | Force Exerted on Paper Feed Roller (g): Longitudinal Feed, Paperless | Longitudinal Feed, 250 Sheets | Lateral Feed, Paperless | Lateral Feed, 250 Sheets |
|---|---|---|---|---|---|---|---|
| 1 | I | I | I | 340 | 730 | 420 | 700 |
| 2 | III | I | II | 320 | 600 | 460 | 530 |
| 3 | III | I | I | 230 | 480 | 360 | 430 |

As is evident from Table 2, it is in the case of Example No. 3 that a variation in the force exerted on the paper holding plate 25 is smallest and that the "Force Due to Spring" is closest to the 300–400 g range from the state when the 250 sheets are placed on the paper holding plate 25 to the paperless state. Consequently, in the present embodiment the springs are positioned as described in Example No. 3.

Figure 9:
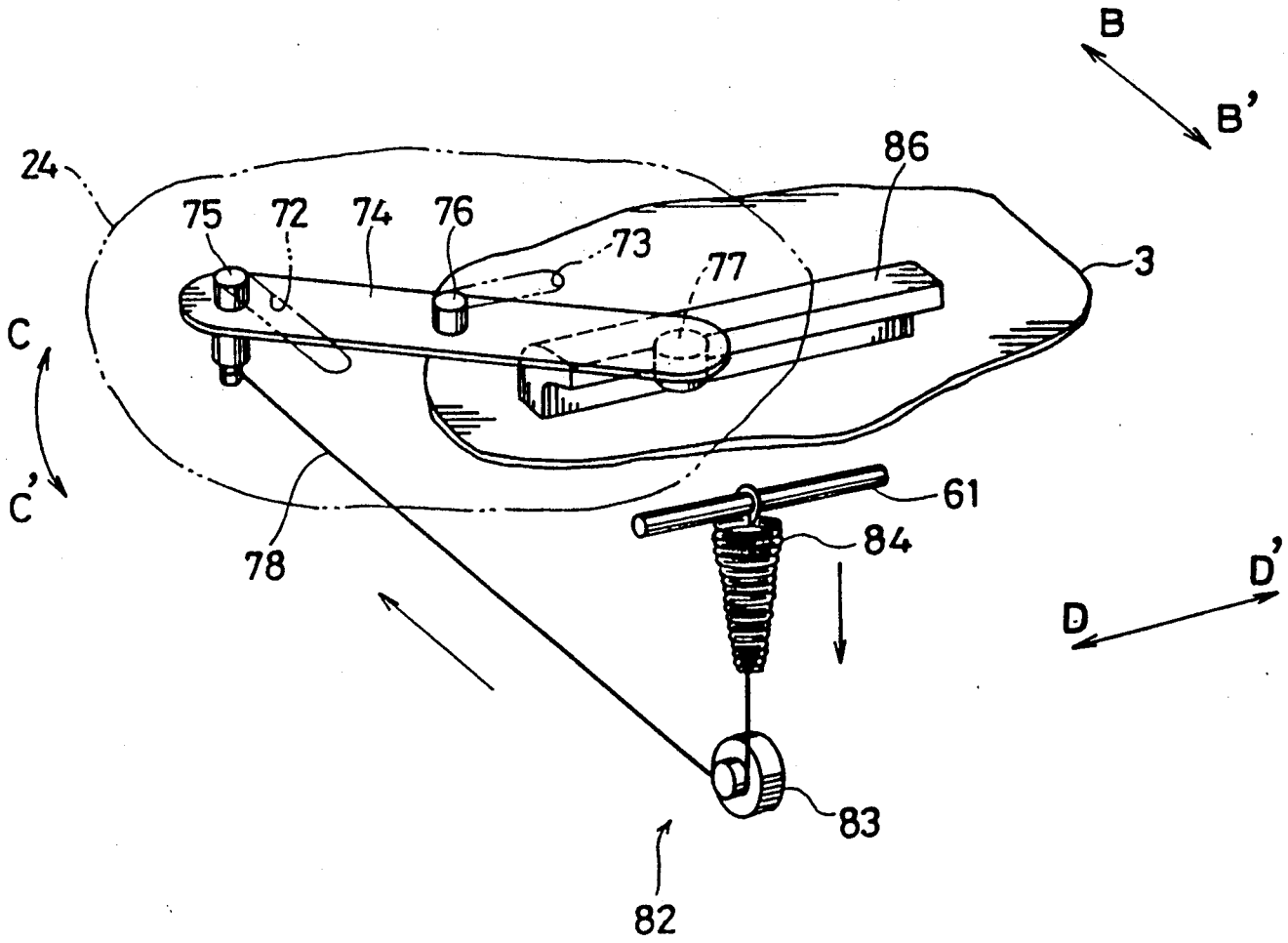

As shown in FIG. 6, a first lateral feed guide slit 72 is formed on a bottom wall of the outer case 24 in a vicinity of the lateral feed supported section 28. The first lateral feed guide slit 72 extends in the directions B—B' when the rotatable paper tray 4 is in the lateral feed position. A second lateral feed guide slit 73 is formed alongside the first lateral feed guide slit 72. The second lateral feed guide slit 73 extends substantially in the directions D—D'. A first guide pin 75 and a second guide pin 76 are provided respectively on an end section and substantially central section of a lateral feed slide plate 74 which serves as a displacement member. The first guide pin 75 is inserted into the first lateral feed guide slit 72 and the second guide pin 76 is inserted into the second lateral feed guide slit 73. A junction pin 77 is provided on the other end section of the lateral feed slide plate 74. As shown in FIGS. 7 and 9 as well, one end of a wire 78 is fixed to the first guide pin 75, and the other end of the wire 78 is fixed to one end of a draft spring 84 via a roller 83. Accordingly, a displacement transmission mechanism 82 is composed of the wire 78, the roller 83 and the draft spring 84. An other end of the draft spring 84 is fixed to the rotary pivot rod 61 of the lateral feed supported section 28. When the rotatable paper tray 4 is rotated to the lateral feed position, the lateral feed slide plate 74 rotates in a direction C. The lateral feed slide plate 74 is guided by the first and second lateral feed guide slits 72 and 73 to rotate in the direction C when the junction pin 77 shifts along a guide rib 86. The guide rib 86 serves as a guide member and is provided on a bottom wall of a tray storing case 3 in the directions D—D'.

As shown in FIG. 11, a first longitudinal feed guide slit 66 is similarly formed on the bottom wall of the outer case 24 in a vicinity of the longitudinal feed supported section 29. The first longitudinal feed guide slit 66 extends in the directions B—B' when the rotatable paper tray 4 is in the longitudinal feed position. A second longitudinal feed guide slit 67 is formed so as to extend substantially in the directions D—D'. A first guide pin 69 and a second guide pin 70 are provided respectively on an end section and a substantially central section of a longitudinal feed slide plate 68 which serves as a displacement member. The first guide pin 69 is inserted into the first longitudinal feed guide slit 66 and the second guide pin 70 is inserted into the second longitudinal feed guide slit 67. A junction pin 71 is provided on the other end section of the longitudinal feed slide plate 68. One end of a wire 78 is fixed to the first guide pin 69, and the other end of the wire 78 is fixed to a rotary pivot rod 61 of the longitudinal feed supported section 29 via the draft spring 84. When the rotatable paper tray 4 is rotated to the longitudinal feed position, the longitudinal feed slide plate 68 rotates in the direction C. The longitudinal feed slide plate 68 is guided by the first and second longitudinal feed guide slits 66 and 67 to rotate in the direction C when the junction pin 71 shifts along a guide rib 85. The guide rib 85 serves as a guide member and is provided on the bottom wall of the tray storing case 3 in the directions D—D'.

With the above arrangement, when the rotatable paper tray unit 1 is attached to the paper feeding device housing 2, the screw shaft 19 fits into the coupling clutch 12 so that the screw shaft 19 can rotate due to the motor 5.

When, as shown in FIG. 6, the rotatable paper tray 4 is in the lateral feed position, the junction pin 77 of the lateral feed slide plate 74 engages with the guide rib 86 and is pushed in the direction B', as shown in FIG. 9 as well. The lateral feed slide plate 74 rotates in the direction C on being guided by the first and second lateral feed guide slits 72 and 73. Consequently, the wire 78 is pulled in the direction B and, as shown in FIG. 7 as well, the rotary pivot rod 61 of the lateral feed supported section 28 is pulled downwards by the draft spring 84 and is guided into the openings 62*a* of the rod supporting member 62. Accordingly, two corner sections (in the direction B) of the copy paper 44 stacked on the paper holding plate 25 come into contact with the clip members 60*a* and 60*b* due to the force exerted upwards by the coiled springs 63–65 on the paper holding plate 25. The copy paper 44 is now ready to be fed.

Here, the first guide pin 69 has been pulled by the draft spring 84 via the wire 78, which causes the longitudinal feed slide plate 68 to be guided and rotated in the direction C' by the first and second longitudinal feed guide slits 66 and 67.

Next, when the motor 5 causes the rotatable paper tray 4 to rotate to the longitudinal feed position, the moving segment 20 moves in the direction D due to the rotation of the screw shaft 19 and the rotatable paper tray 4 begins to rotate from the lateral feed position to the longitudinal feed position. Accompanying this, the junction pin 77 of the lateral feed slide plate 74 separates from the guide rib 86. Then, the first guide pin 75 is pulled by the draft spring 84 via the wire 78. This causes the lateral feed slide plate 74 to be guided by the first and second guide slits 72 and 73 and to shift to a position shown by an alternate long and short dash line in FIG. 6, i.e., to be substantially parallel to an end section (located toward the direction B) of the paper holding plate 25.

From this position, when the rotatable paper tray 4 rotates further, it reaches the longitudinal feed position, as shown in FIG. 11. The junction pin 71 of the longitudinal feed slide plate 68 comes in contact with the guide rib 85 and is pushed in the direction B'. The longitudinal feed slide plate 68 rotates in the direction C on being guided by the first and second longitudinal feed guide slits 66 and 67. That is, the longitudinal feed slide plate 68 rotates from a position shown by an alternate long and short dash line to a position shown by a solid line. Consequently, the wire 78 is pulled in the direction B and the rotary pivot rod 61 of the longitudinal feed supported section 29 is pulled downwards by the draft spring 84 and guided into the openings 62*a* of the rod supporting member 62. Accordingly, corner sections (in the direction B) of the copy paper 44 placed on the paper holding plate 25 come into contact with the clip members 60*b* and 60*c*. The copy paper 44 is now ready to be fed.

Here, an axis develops along the imaginary straight line 87 (see FIG. 10) on the paper holding plate 25 and a force acts downwards on corner sections lying adjacent the clip member 60*b*, i.e., corner sections whereon the clip member 60*a* and 60*c* are disposed. This force is, however, cancelled out by the coiled spring 65 disposed in the area proximate to the supported section 27, the area being formed by the intersection of the imaginary straight lines 89 and 91. Consequently, both the corner sections of the copy paper 44 stacked on the paper holding plate 25, which face the paper feed direction are suitably clamped down by the clip members 60*a* and 60*b* or the clip members 60*b* and 60*c*, whereby paper feed can take place reliably.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper feeding device comprising:

a paper storing member for storing copying material, the paper storing member being movable to a longitudinal feed position for feeding the copying material oriented longitudinally with respect to a feeding direction and to a lateral feed position for feeding the copying material oriented laterally with respect to the feeding direction;

a movable paper holding member formed as part of said paper storing member for holding said copying material therein;

driving means for selectively moving the paper storing member to the longitudinal feed position or to the lateral feed position;

lifting up means for setting the paper holding member so as to be ready to feed the copying material held therein when the paper storing member is moved to the longitudinal feed position or the lateral feed position; and lifting up drive means, responsive to a force provided by the paper storing member when the paper storing member is moved either to the longitudinal feed position or to the lateral feed position by said driving means, for driving said lifting up means so that said lifting up means sets the paper holding member so as to be ready for feeding the copying material held therein.

2. A paper feeding device as set forth in claim 1 wherein said paper storing member comprises:

a rotatable tray which is rotatable to said longitudinal feed position and to said lateral feed position, said paper holding member being a paper holding plate which can be raised or lowered in said rotatable tray; and said lifting up means including paper holding plate setting means responsive to a force provided by said rotatable tray when it is rotated to a feed position for setting said paper holding plate in a position for feeding said copying material.

3. A paper feeding device as set forth in claim 2 wherein said paper holding plate setting means includes a paper holding plate driving member.

4. A paper feeding device as set forth in claim 3, wherein said lifting up drive means includes a driving force applying means for applying said force to said paper holding plate driving member and a driving force transmission means responsive to said driving force applying means for transmitting said force to said paper holding plate driving member.

5. A paper feeding device as set forth in claim 3 wherein said lifting up drive further includes a second paper holding plate driving member and a lifting-up guide means for driving said second driving member when said rotatable tray is in a feed position.

* * * * *